US009061321B2

(12) United States Patent
Kosilov

(10) Patent No.: US 9,061,321 B2
(45) Date of Patent: Jun. 23, 2015

(54) SEPARATING MACHINE FOR SEPARATING LOOSE MIXTURES IN A FLUID

(71) Applicant: Volodymyr Mytrofanovych Kosilov, Lugansk (UA)

(72) Inventor: Volodymyr Mytrofanovych Kosilov, Lugansk (UA)

( * ) Notice: Subject to any disclaimer, the term of this patent is extended or adjusted under 35 U.S.C. 154(b) by 0 days.

(21) Appl. No.: 14/159,471

(22) Filed: Jan. 21, 2014

(65) Prior Publication Data

US 2014/0353219 A1 Dec. 4, 2014

(30) Foreign Application Priority Data

May 31, 2013 (RU) ..... 2013125322

(51) Int. Cl.
*B07C 5/00* (2006.01)
*B07B 4/02* (2006.01)
*B07B 4/00* (2006.01)

(52) U.S. Cl.
CPC .... *B07B 4/02* (2013.01); *B07B 4/00* (2013.01)

(58) Field of Classification Search
USPC ..... 209/644, 132, 134, 142, 149
See application file for complete search history.

(56) References Cited

U.S. PATENT DOCUMENTS

| | | | | |
|---|---|---|---|---|
| 2,941,667 | A * | 6/1960 | Hilgartner, Jr. et al. | 209/134 |
| 3,135,684 | A * | 6/1964 | Jakob et al. | 209/139.2 |
| 4,432,748 | A * | 2/1984 | Novoselac et al. | 494/2 |
| 6,283,300 | B1 * | 9/2001 | Bielagus et al. | 209/29 |
| 2011/0067569 | A1 * | 3/2011 | Valerio et al. | 95/268 |
| 2014/0216991 | A1 * | 8/2014 | Suhin | 209/644 |
| 2014/0353219 | A1 * | 12/2014 | Kosilov | 209/644 |

FOREIGN PATENT DOCUMENTS

| | | | | |
|---|---|---|---|---|
| EP | 2186575 | A1 * | 5/2010 | B07B 4/02 |
| FR | 975556 | A | 3/1951 | |
| GB | 2110959 | A * | 6/1983 | B07B 4/02 |
| RU | 2270061 | C2 | 2/2006 | |
| RU | 63716 | U1 | 6/2007 | |
| RU | 68930 | U1 | 12/2007 | |
| RU | 2336131 | C1 | 10/2008 | |
| RU | 2340411 | C1 | 12/2008 | |
| RU | 88584 | U1 | 11/2009 | |
| SU | 1321486 | A1 | 7/1987 | |
| WO | WO 2011090452 | A1 * | 7/2011 | |

* cited by examiner

*Primary Examiner* — Terrell Matthews

(57) ABSTRACT

The invention relates to equipment for sorting loose solids, in particular the seeds of grain, vegetable and herb crops using airflows.

Figure 1:
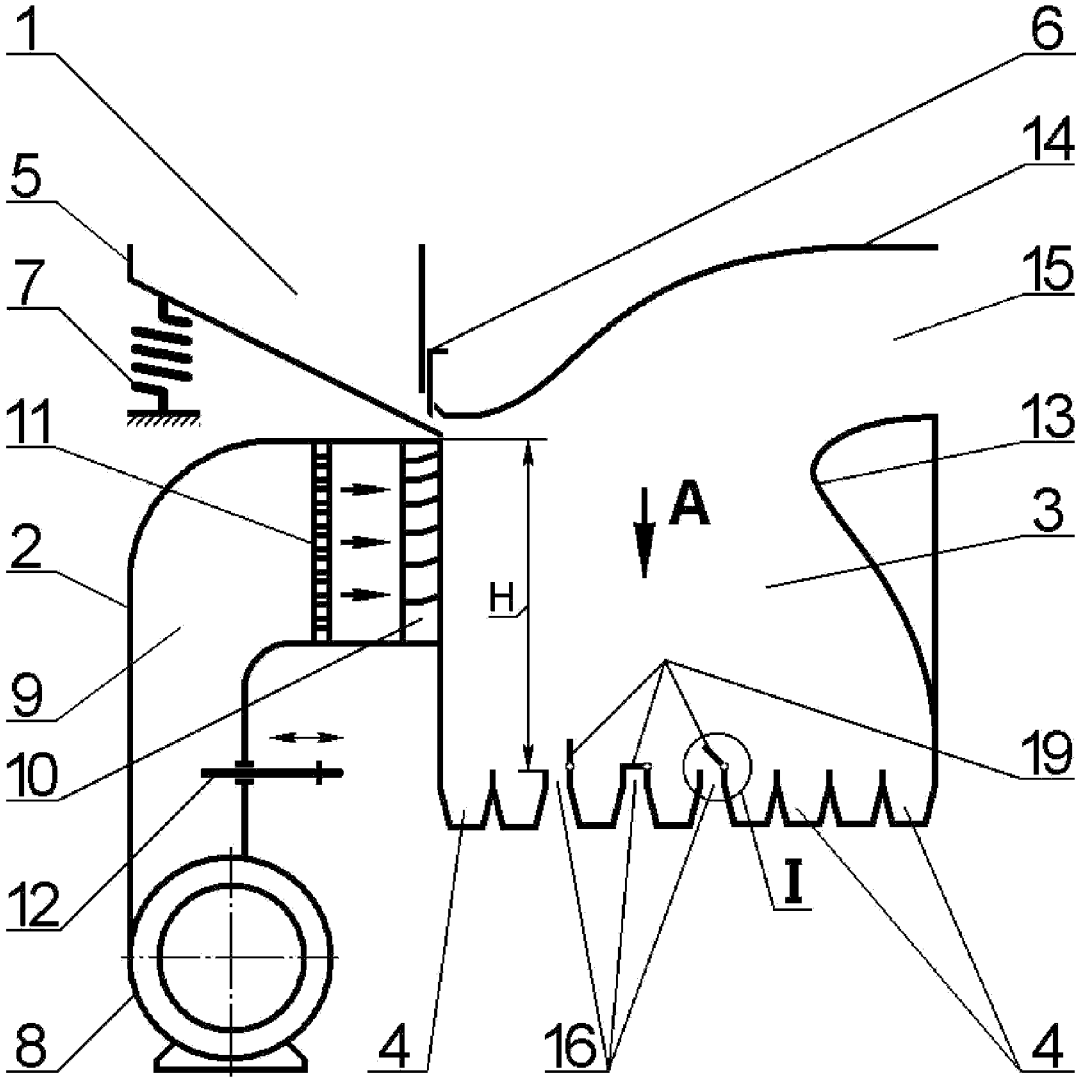

A separating machine for separating loose mixtures in a fluid, comprising loose mixture loading and feeding means, a fluid oscillator with nozzles and air blowers placed thereunder, a separation chamber with a cover, an air flow baffle placed on the separation chamber rear wall and ready and recycled fractions collectors placed on its bottom, wherein the separation chamber bottom is provided with an ascending air flow generator performed as ejection openings for outside air inflow, placed between the fractions collectors.

8 Claims, 3 Drawing Sheets

View A

SEPARATING MACHINE FOR SEPARATING LOOSE MIXTURES IN A FLUID

The invention relates to equipment for sorting loose solids using air flows, and more particularly to automatics for purifying the seeds of grain, vegetable and herb crops, and can be used at plant-breeding stations, seed factories, farms, grain elevators, in the milling and fodder production.

From the state of the art there are known loose material separation devices each comprising a hopper, a separation chamber, a nozzle for an air flow supply connected to a blower, ready fractions collectors, rf. utility model pat. RU 63716, IPC B07B4/02, publ. Jun. 10, 2007, or utility model pat. RU 68930, IPC B07B4/02, publ. Dec. 10, 2007, or utility model pat. RU 88584, IPC B07B4/02, publ. Nov. 20, 2009, or invention pat. RU 2270061, IPC B07B4/02, publ. Feb. 2, 2006, or invention pat. RU 2340411, IPC B07B11/00, publ. Dec. 10, 2008. The common drawback of said up-to-date devices is the lack of the ascending air flow directed towards the loose material being separated, thus reducing the effective stay time of the loose material in the separation chamber and leading to the separation conditions worsening, as well as to unreasonable increase of the separation chamber and the whole device overall dimensions.

It is known a separating machine, for separating dissimilar materials the machine comprising a separation chamber provided in its upper part with a feeder for the material to be processed, which falls freely into said chamber, a means for introducing into said chamber gas flows making the material move at a certain rate and in a certain direction, devices and systems for collecting the material in different fractions collector points wherein the hoppers the ready fractions are collected in may be equipped with means generating the ascending gas flow for lighter products sublimation wherein the fractions collector points may be separated from each other with mobile flaps for regulating the composition of the product obtained, see patent FR975556, published in Mar. 7, 1951 Similarly to some other solutions mentioned above, in said machine an opposite ascending flow is injected from the fractions collector hoppers wherein the mobile flaps acting not as ascending flow regulators but as a means regulating the fractions quantity ratio.

It is known a separating machine for separating loose mixtures in a fluid, the machine comprising loose mixture loading and feeding means, a fluid oscillator with nozzles and an air blower arranged thereunder, a separation chamber, ready and recycled fractions collectors, at least one air flow baffle, made in the form of a convex surface, arranged on the separation chamber rear wall, an ascending air flow generator performed as ejection openings for outside air inflow, placed in the separation chamber bottom between several fractions collectors, wherein the convex surface being wavy, the separation chamber length making 1.3-1.5 of its height, the separation chamber width making 2.1-2.3 of its height and the ejection openings for outside air inflow arranged between the third and the fourth ready and recycled fractions collectors, each ejection opening for outside air inflow being provided either as a slot its width making 0.02-0.03 of the separation chamber height, or as a set of circular or rectangular openings, arranged into variable pitch arrays, see invention patent RU 2336131, IPC B07B4/02, publ. Oct. 20, 2008. As follows from description, the device may further contain one or more grids for air flow straightening and allows for increasing the effective stay time of the loose material particles being separated in the separation chamber and reducing the separating air flow turbulence degree while preserving a high quality in processing the products of various mechanical characteristics being separated. A prior art drawback is an uncontrollable character of the ascending air flow due to a lack of means enabling to change intensity and direction of the outside air flow ejected into the separation chamber. The mentioned feature of the prior art in case of the ascending airflow insufficient intensity occurring frequently in the transient and unstable modes may cause the fraction particles of the product being separated fall out from the separating chamber through the ejection opening beside the ready and recycled fractions collectors, thus reducing the processing quality and completeness. Said prior art drawbacks limit the effective application domain making it unsuitable for this invention.

The invention as claimed aims at achieving new technical effect, which is expressed in the fact that the separating machine for separating loose mixtures implements the ability to control the intensity and direction of the ascending air flow entering the separation chamber through the ejection openings including its complete locking. Finally, said technical effect allows for increasing the loose mixture separation completeness thereby improving the performance. At the same time, the structure maximally preserves all the prior art strong points, including an increased effective stay time of the loose material in the separation chamber and a reduced turbulence degree of the separating air flow.

An positive effect is achieved with a separating machine for separating loose mixtures in a fluid, comprising loose mixture loading and feeding means, a fluid oscillator with nozzles and an air blower arranged thereunder, a separation chamber with a cover, an air flow baffle arranged on the separation chamber rear wall and ready and recycled fractions collectors placed on its bottom, wherein the separation chamber bottom is provided with an ascending air flow generator made in the form of ejection openings for outside air inflow, arranged between the fractions collectors, wherein the separating machine as opposed to the prior art is equipped with a straightener arranged in the fluid oscillator upstream the nozzles, a blower flow rate control and at least a guide flap mounted at the ascending air flow generator output.

Preferably the straightener is made in the form of at least one flat grid arranged in the fluid oscillator air duct perpendicular to the air flow direction, a blower flow rate control is made in the form of a sliding gate arranged between the blower and the straightener, the fluid oscillator air duct flow section being lockable; a guide flap is made in the form of a rotatably mounted rectangular plate enabling locking of the ascending air flow former flow section wherein in the completely unlocked position the plate is vertical and in the halfway position it is able to deflect the ascending air flow towards the nozzles. A wavy shape of the separation chamber cover and airflow baffle surface helps improving the machine aerodynamic properties. In terms of achieving the above technical effect the optimal separation chamber length makes 1.3-1.5 of its height, and the optimal separation chamber width makes 2.1-2.3 of its height. It is reasonable to arrange the ejection openings for outside air inflow between the second, the third and the fourth ready and recycled fractions collectors. It is possible to perform the ejection openings in the form of a slot, its width making 0.02-0.03 of the separation chamber height. Alternatively the ejection openings for outside air inflow may be performed as a set of circular or rectangular openings.

When carrying out precise multifractional separation and fine purification of a loose mixture in a fluid through a horizontal air flow, a key role belongs to the effective stay time of the loose material particles within said air flow i.e. in the separation chamber. The longer the stay time of the particles is, the greater amount of the separated product fractions is to be isolated and the greater amount of volatile fractions is to be withdrawn. The effective stay time increased through the separation chamber overall height extension above one meter is associated with increased energy and material consumption of the machine. Creating an ascending air flow toward the commercial fractions particles of the loose mixture allows for slowing their fall down under gravity and for increasing their effective stay time in the separation chamber operating area. Thus the ascending airflow generating does not require additional energy, since it is carried out due to the outside air ejection by ejection through the ejection openings. The ascending airflow allows for isolation of at least four commercial fractions containing less than 1.5-2.0% substandard material in a fraction with a separation chamber height not exceeding 0.9 meters. The machine performance mainly depends on the separation chamber width, the latter making 2.1-2.3 of its height the prove-in performance is optimal. The separation chamber length depends on the mechanical properties of the material being processed and its magnitude making 1.3-1.5 of its height the most versatility of the machine is ensured. The width of the ejection openings slot making 20 . . . 25 mm is established experimentally as the one providing maximal ejection effect. Performing the ejection openings in the form of circular or rectangular openings with a certain pitch allows straightening the ascending airflow velocity profile easily across the entire separation chamber width. Stabilizing the ascending airflow velocity is facilitated due to the self-oscillations of the rotatable guide flaps mounted on the ejection openings. Stabilizing the fluid oscillator main airflow rate and direction is facilitated due to the blower flow rate control and a straightener, successively mounted in the fluid oscillator air duct flow section. Thus, in the separating chamber it is maintained an optimum ratio of the main airflow and the ascending air flow intensity.

The quality of the loose mixture separation and fine purification in a fluid as well as the machine operation consistency largely depend on the character of airflow movement in the separation chamber. In the case of airflow disruption, formation of turbulence or dead zones, a sharp decrease of the machine efficiency is observed. Said phenomena also occur in the separation chamber due to the airflow interaction with its construction elements. The airflow turbulence probability is maximal when the air flow interacts with the separation chamber cover and its rear wall, so to improve the aerodynamics the separation chamber is equipped with an air flow baffle. The surface of the separation chamber cover and the airflow baffle is provided convex-concave and wavy. Such surface shape contributes to improving aerodynamics, minimizing resistance to airflow and eliminating dead zones occurrence.

Therefore, as opposed to the prior art all the characteristic features of the separating machine for separating loose mixtures in a fluid are aimed at obtaining a technical effect, in particular, at enabling to control the ascending airflow intensity and direction.

The technical solution, characterized in a set of essential features as described, is novel and industrially applicable.

The technical solution is illustrated by means of the drawings as follows.

Figure 2:
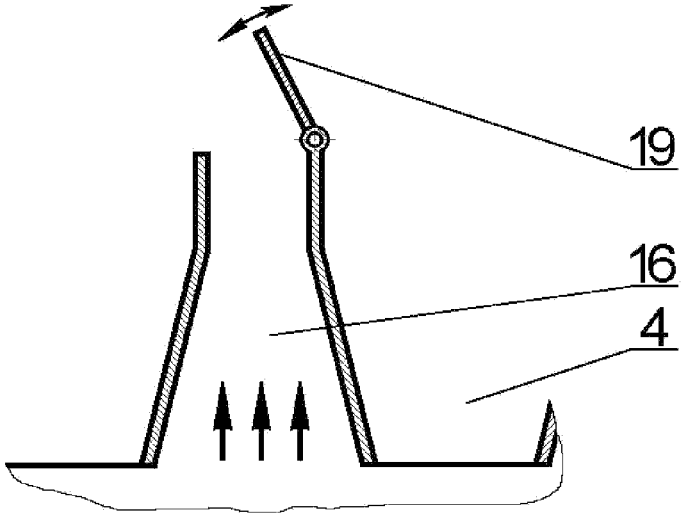
Figure 3:
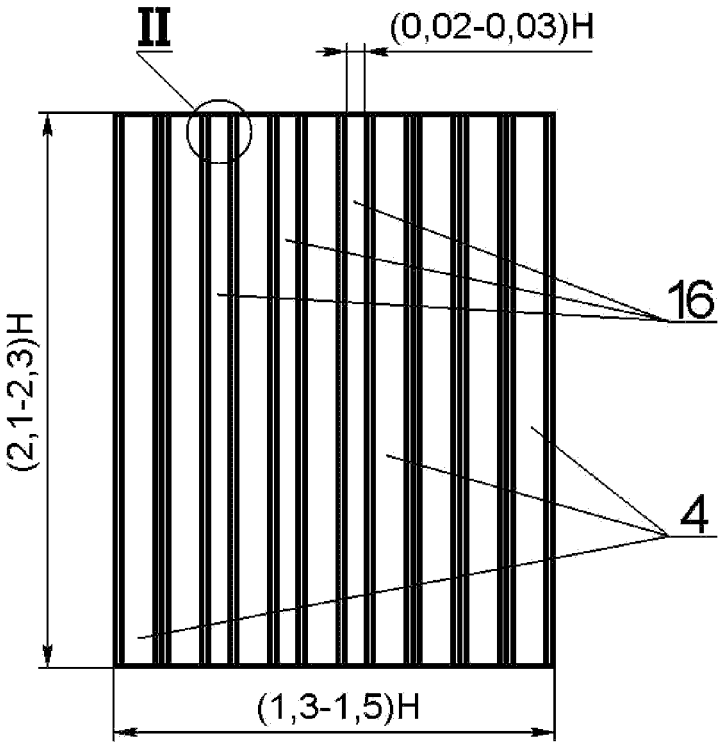
Figure 4:
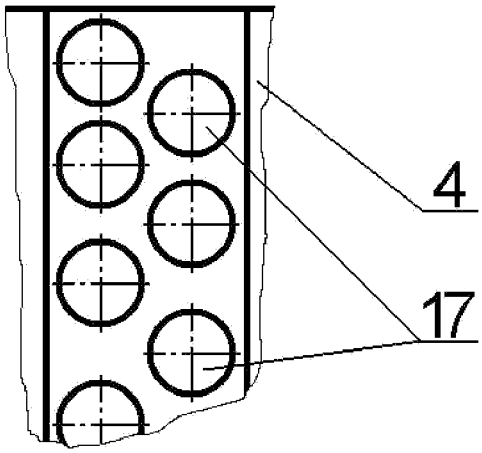
Figure 5:
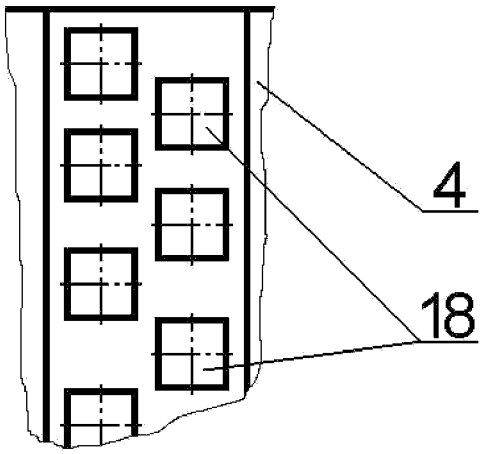

FIG. 1 shows a general view of a separating machine for separating loose mixtures in a fluid;

FIG. 2—unit I of FIG. 1, an enlarged view, the guide flap being in a half-way position;

FIG. 3—view A of FIG. 1;

FIG. 4—unit II of FIG. 3, an enlarged view, the ejection opening for outside air inflow performed as a set of openings;

FIG. 5—the same as in FIG. 4, the openings being of rectangular shape.

A separating machine for separating loose mixtures in a fluid comprising loose mixture loading and feeding means 1, a fluid oscillator 2, a separation chamber 3, ready and recycled fractions collectors 4. Wherein the loose mixture loading and feeding means 1 comprises a hopper 5, provided with a sliding gate 6 and a vibration means 7 (schematically shown in the figure as a spring) for the loose mixture uniform feeding into the separation chamber 3.

The fluid oscillator 2 is installed under the hopper 5 and consists of an air blower 8, for example, performed as a fan, an air duct 9 and a set of oriented flat nozzles 10. Inside the air duct 9, just upstream the nozzles 10 it is provided a straightener 11 for straightening the air flow, arranged in the form of a flat grid (in the figure a single flat grid is schematically shown, the main air flow direction being indicated with a group of arrows perpendicular to the grid). It is possible to perform the straightener 11 in the form of several grids or meshes arranged in series to be mounted in the air duct 9 flow section perpendicularly to the main air flow direction. Inside the air duct 9, between the blower 8 and the straightener 11 it is provided a flow rate control 12 of said blower 8 performed in the form of a sliding gate, the fluid oscillator 2 air duct 9 flow section being lockable with (the sliding gate shown in an half-way position, the possible direction of its movement indicated with a double-headed arrow). The flow rate control 12 may be essentially mounted at the blower 8 input, and its embodiment may include a variety of mechanical and electronic elements.

The separation chamber 3 represents a rectangular closed space, its height being its characteristic dimension. In the drawings the separation chamber 3 height is indicated with the letter H, respectively, the separation chamber 3 length makes (1.3-1.5) H, and the separation chamber 3 width makes (2.1-2.3) H. On the inner surface of the separation chamber 3 rear wall opposite the nozzles 9 it is provided an airflow baffle 13. The separation chamber 3 upper part is provided with a cover 14. The airflow baffle 13 and the cover 14 are made in the form of as a convex-concave wavy surface. The separation chamber 3 side walls may be of a wavy shape as well. Over the baffle 13 in the upper part of the separation chamber 3 rear wall, it is provided an aperture 15 for discharging the air flow and highly volatile fractions out of the separation chamber 3. The separation chamber 3 bottom represents an array of ready and recycled fractions collectors 4 alternating in a certain successiveness. The collectors 4 division according to their purpose into the ones for ready and recycled fractions is conditional depending on the properties of the loose mixture being processed. The collector 4 serial number based on its distance from the separation chamber front wall (equipped with nozzles) is quite essential. So in the first collector 4 being next to front wall the most dense fractions will be collected, and the distance to a collector 4 extended the density of the fraction collected therein would go down. The collectors 4 represent separating grooves arranged across the separation chamber 3 broadwise, each groove provided with a discharge neck (not schematically shown in the figures).

Besides the collectors 4 in the separation chamber 3 bottom it is mounted an ascending air flow generator, performed as an array of ejection openings 16 for outside air inflow. The ejection openings 16 are shown placed between the second and the third, the third and the fourth, the fourth and the fifth collectors 4. Although the ejection openings 16 may be arranged between the other collectors 4 as well, in particular between all of them. According to the simplest embodiment (rf. FIG. 3) of the machine, each ejection opening 16 for outside air inflow is made in the form of a rectangular slot its length making 2.1-2.3 of the separation chamber 3 height and its width making 0.02-0.03 of the separation chamber 3 height. An embodiment (rf. FIG. 5) is possible wherein each ejection opening 16 for outside air inflow is performed as an array of circular openings 17, or (ref FIG. 5) rectangular openings 18. In this case the openings 17 and 18 in the arrays are arranged with a varied pitch therebetween, i.e. the center-to-center distances of the openings 17 or 18 differ.

The machine is equipped with at least a guide flap 19 mounted at the ascending airflow generator output, i.e. along the ejection opening 16 edge. FIG. 1 shows a machine with three guide flaps 19 arranged on all the three ejection openings 16 for outside air inflow. Each guide flap 19 is made in the form of a rectangular plate, pivotally mounted along the ejection opening 16 longer side, the guide flap being rotatable thus bringing the ejection opening 16 flow section into a completely locked position. Referring to FIG. 1 the guide flaps 19 are shown in three different positions, so that the next to the nozzles 10 guide flap 19 is shown in a completely unlocked position, i.e. being vertically oriented, the middle one—is shown in a completely locked position of the ejection opening 16 flow section, i.e. being horizontally oriented, and the most distant one from the nozzles 10—is shown in a half-way position i.e. being inclined (also ref. FIG. 2). Each guide flap 19 position may be visualized in each operation point, for example by means of a streamer (not shown in the figures) connected to the guide flap 19 and arranged outside the separation chamber 3. The ascending airflow direction in the ascending airflow former flow section is schematically indicated in FIG. 2 with a series of arrows.

The machine operates as follows.

A loose mixture to be separated, for example grain is fed to the loose mixture loading and feeding means 1 hopper 5. The machine connected to the power supply line both vibration means and fluid oscillator 2 start operating. The fluid oscillator 2 started in a set mode the sliding gate 6 is swung up and the input loose mixture particles are fed to the separation chamber 3 in a smooth manner. The fluid oscillator 2 optimal operation mode is chosen through moving the sliding gate of the air blower 8 flow rate control 12. The blower 8 insufficient performance is characterized in the guide flap 19 drop in a completely locked position of the ejection opening 16 flow section and hence an increased content of the material being separated observed in the first collectors 4. The blower 8 excessive performance is characterized in all the guide flaps 19 being completely unlocked and an increased content of the material being separated observed in the ultimate collectors 4 yet the low-density grain fractions being ejected through the aperture 15. The air present in the air duct 9 flow section of the straightener 11 provided in the form of several grids or meshes arranged in series, allows to generate a uniform main flow at the nozzles 10 input, characterized in minimal rate and direction gradient across the whole section, that is of critical importance for stable operation of the nozzles 10 and the fluid oscillator 2 as a whole. However to minimize pressure and turbulence losses it is important to make the airflow of the blower 8 enter the straightener 11 at right angle.

Due to a set of oriented flat nozzles 10 the fluid oscillator 2 provides a uniform and essentially horizontal airflow fed to separation chamber 3. The airflow of the fluid oscillator 2 picks up the bulk of the material being separated freely falling from the hopper 5. The loose mixture being affected with a monitoring cascade of flat air streams results in dividing the particles of the material being separated into fractions of different density and aerodynamic characteristics. More dense and more rounded particles sink in the first collector 4 zone, and the less dense ones with a shaped surface are dropped out to the ulterior collectors 4. Consequently, stones and other heavy impurities fall into the first collector 4 zone, the seed grain—into the second collector zone, the bread grain—into the third collector zone, the feed grain—into the fourth and the fifth collector zone, and non-commercial fractions of the loose mixture fall into the ulterior collector zone. The highly volatile and dusty fractions are carried with the fluid oscillator 2 airflow and ejected from the separation chamber 3 through the aperture 15 for air flow discharge. Stabilizing the laminar (vortex-free) airflow stream within the separation chamber 3 is facilitated due to the well-rounded wavy surface of the cover 14 and the airflow baffle 13.

The ejection openings 16 for outside air inflow are advantageously arranged between the commercial fractions collectors 4 and provide conditioning thereof. The airflow of the fluid oscillator 2 moving along the separation chamber 3 thus forming a fluid, a vacuum arises therein with respect to the ambient atmosphere, resulting in the outside air ejection (inflow) into the separation chamber 3 through the ejection openings 16 of the ascending airflow generator. The ejected outside air ascending airflow comes up through the ejection openings 16 bottom-upwards toward the particles of the loose mixture commercial fractions, falling into corresponding collectors 4. Thus, there occurs a counterflow between the outside air ascending airflow and the loose mixture commercial fractions particles resulting in slowing their fall down (suspending), increasing their effective stay time in the separation chamber 3 operating area and improving the commercial fractions separating accuracy up to 98-98.5%, while the non-commercial fractions percentage not exceeding 1.5-2.0%. The separated loose mixture fractions are collected in corresponding collectors 4 and regularly discharged therefrom for further processing.

Whereas the intensity of the ascending airflow fed to the separation chamber 3 through the ejection openings 16 depends on vacuum level therein, the vacuum (main flow rate) being insufficient the flow rate of the outside air ejected into the separation chamber 3 through the ejection openings 16 drops as well, though due to the guide flaps 19 rotation and the fluid oscillator air duct flow section being partially locked the ascending airflow rate is preserved, that allows to maintain the optimal separation mode thus ensuring the effective stay time of the commercial fractions particles in the separation chamber 3 operating area. Whereby owing to the change of the ascending airflow direction, the flow being reflected by the inclined guide flap 19 toward the nozzles 10, the effective separation area shifts towards the nozzles 10 as well, its characteristics being preserved. Advantageously the guide flaps 19 are freely pivotally mounted enabling an automatic control of the ascending airflow intensity up to complete locking of the ascending airflow former flow section with the guide flap 19 under gravity. The complete or substantially complete locking occurs in the transient and unstable modes, is far from optimal and signalizes the necessity of the blower 8 flow rate control 12 slide flap shifting to increase the fluid oscillator 2 performance. However, while substantially reducing the ascending air flow intensity and locking the guide flaps 19, it is prevented the occasional penetration of the separated product fractions from the separation chamber 3 through the ejection openings 16, whereby said particles rolling down the external surface of the guide flaps 19 into the adjacent ready and recycled fractions collectors 4.

The above-described embodiments of the separating machine for separating loose mixture are not exhaustive and are presented in order to clarify the invention and confirm its industrial applicability. Those skilled in the art may improve it and/or implement alternative embodiments within the scope of this invention, as reflected in its description.

The machine may be efficiently applied when carrying out multifractional separation of a loose mixture, including grain crops both rounded and shaped, this fact being of great importance for purposes of agricultural selection as well as when processing and preparing the seed grains. Moreover being reliable and economically efficient the machine does not require specially trained personnel for its operation and maintenance.

The invention claimed is:

1. A separating machine for separating loose mixtures in a fluid, comprising loose mixture loading and feeding means, a fluid oscillator with nozzles and an air blower arranged thereunder, a separation chamber with a cover, an air flow baffle arranged on the separation chamber rear wall and ready and recycled fractions collectors placed on its bottom, wherein the separation chamber bottom is provided with an ascending air flow generator performed made in the form of ejection openings for outside air inflow, placed between the fractions collectors, the separating machine characterized in that it is equipped with a straightener arranged in the fluid oscillator upstream the nozzles, an air blower flow rate control and at least a guide flap mounted at the ascending air flow generator output, the straightener is made in the form of at least a flat grid arranged in the fluid oscillator air duct perpendicular to the air flow direction, the air blower flow rate control is made in the form of a sliding gate arranged between the air blower and the straightener, the fluid oscillator air duct flow section being lockable.

2. The machine of claim 1 characterized in that the guide flap is made in the form of a rotatably mounted rectangular plate locking the ascending air flow generator flow section wherein in the completely unlocked position the plate is vertical and in the half-way position it enables to deflect the ascending air flow towards the nozzles.

3. The machine of claim 2 characterized in that the separation chamber cover and airflow baffle surface is wavy.

4. The machine of claim 3 characterized in that the separation chamber length makes 1.3-1.5 of its height, and the separation chamber width makes 2.1-2.3 of its height.

5. The machine of claim 4 characterized in that the ejection openings for outside air inflow are placed between the second, the third and the fourth ready and recycled fractions collectors.

6. The machine of claim 5 characterized in that each ejection opening for outside air inflow is made in the form of a rectangular slot its length making 2.1-2.3 of the separation chamber height.

7. The machine of claim 6 characterized in that each ejection opening for outside air inflow is performed as an array of openings.

8. The machine of claim 7 characterized in that the openings are rectangular.

* * * * *